US006877412B2

(12) United States Patent
Supe-Dienes

(10) Patent No.: US 6,877,412 B2
(45) Date of Patent: Apr. 12, 2005

(54) BLADE HOLDER WITH CUTTING FORCE ADJUSTMENT INDEPENDENT OF STROKE

(75) Inventor: Rudolf Supe-Dienes, Overath (DE)

(73) Assignee: Dienes Werke für Maschinenteile GmbH & Co. KG (DE)

( * ) Notice: Subject to any disclaimer, the term of this patent is extended or adjusted under 35 U.S.C. 154(b) by 60 days.

(21) Appl. No.: 09/251,781

(22) Filed: Feb. 17, 1999

(65) Prior Publication Data

US 2004/0163521 A1 Aug. 26, 2004

(30) Foreign Application Priority Data

Feb. 17, 1998 (DE) ..... 198 06 444

(51) Int. Cl.[7] ..... B26D 1/14; B26D 5/04; B26D 7/26

(52) U.S. Cl. ..... 83/482; 83/499; 83/502; 83/503; 83/504; 83/563

(58) Field of Search ..... 83/482, 502, 498, 83/499, 500, 501, 503, 504, 505, 506, 507, 563, 588, 698.51, 698.61, 699.51, 699.61

(56) References Cited

U.S. PATENT DOCUMENTS 3,892,156 A * 7/1975 Johnstone ..... 83/482 X
4,434,695 A * 3/1984 Wingen ..... 83/482
4,824,428 A * 4/1989 Cavagna ..... 83/482 X
4,876,933 A * 10/1989 Tahara ..... 83/482
4,905,554 A * 3/1990 Cavagna ..... 83/482

FOREIGN PATENT DOCUMENTS

DE 26 57 792 6/1978
DE 38 41 576 C1 12/1988
DE 41 14 059 A1 11/1992

* cited by examiner

*Primary Examiner*—Clark F. Dexter
(74) *Attorney, Agent, or Firm*—Robert W. Becker and Associates; Robert W. Becker

(57) ABSTRACT

A blade holder for cutting machines has a blade head secured at a lowering device and a blade head housing having a chamber. The blade head has a blade holding member for receiving a circular blade. An advancing device is mounted in the blade head housing. The advancing device has an advancing piston rod and an advancing piston actuating the advancing piston rod. The advancing piston rod acts on the blade holding member for moving the circular blade between a cutting position and a ready position. The advancing piston is pneumatically actuated and mounted and guided in the chamber. A pressure spring acts on the advancing piston rod to prestress the advancing piston rod into the ready position of the circular blade. A pressing device loads the pressure spring in a direction of the cutting position of the circular blade. The pressing device is decoupled from the advancing piston rod.

14 Claims, 2 Drawing Sheets

BLADE HOLDER WITH CUTTING FORCE ADJUSTMENT INDEPENDENT OF STROKE

BACKGROUND OF THE INVENTION

The invention relates to a blade holder for cutting machines with a blade head, which is supported at a lowering device, and with an advancing device for the circular blade secured at the blade head, whereby the advancing device, for movement of the circular blade between a cutting position and a ready position comprises a compressed-air actuated advancing piston rod with an advancing piston guided in a chamber of the housing of the blade head whereby the advancing piston rod is pretensioned by a pressure spring into the ready position of the circular blade.

A blade holder with the aforementioned features is disclosed in DE 41 14 059 A1. The blade head which supports the circular blade is positioned at the end of a lowering piston rod with which the circular blade is lowered into the cutting plane and, respectively, lifted therefrom. The advancing device arranged within the blade head provides for an adjustment of the circular blade transverse to the axis of the lowering piston into a contact position at a lower blade and, respectively, lifts the circular blade away from the lower blade when no cutting action is performed.

For performing these movements, the advancing device comprises an advancing piston which is actuated by compressed air in the direction of the cutting position of the circular blade, while, for return of the circular blade from the cutting position, a pressure spring is provided that loads the advancing piston rod into the ready position for the circular blade. Accordingly, the cutting force between the circular blade and the corresponding lower blade is predetermined and, respectively, adjustable by the pressing force in the direction of the cutting position of the circular blade provided by the pneumatically activated advancing piston which overcomes the effect of the pretensioned pressure spring.

Such a design of the blade holder has the disadvantage that the aforementioned kind of cutting force control is not sufficiently precise because of the employed pressure spring having own in tolerances and non-constant spring characteristic lines. When in the frame of such a cutting machine a plurality of such blade holders is used, a pneumatic drive pressure adjusted identically for each blade holder and the advancing piston does not accordingly produce an identical cutting force because, as a function of the respectively lifting position of the circular blade, respectively, of the lifting piston rod and as a function of the spring tolerances and the spring characteristic line of the respective pressure spring, a spring force of a different magnitude counteracts the pneumatic drive pressure acting in the direction of the cutting position of the circular blade.

From DE 26 57 792 A1 a blade holder is known in which by eliminating a pressure spring for returning the advancing piston rod into its ready position, the movement of the advancing position rod into the cutting position as well as into the ready position is realized by a pneumatic system. Such an embodiment, however, is complicated with respect to controlling the respective pneumatic drive for the two movement directions.

It is an object of the invention to improve for a blade holder of the aforementioned kind, including a pressure spring for effecting the return of the advancing piston rod, the precision of the cutting force control.

SUMMARY OF THE INVENTION

The invention is based on the basic idea that, for overcoming the force of the pressure spring acting onto the advancing piston rod during the cutting operation, a pressing device is arranged that loads the pressure spring in the direction of the cutting position of the circular blade and is decoupled from the advancing piston rod.

The invention has the advantage that with the additionally provided pressing device the effect of the pressure spring loading the advancing piston rod on the cutting force control is eliminated because after compression of the pressure spring, optionally to the completely compressed "block" state, the cutting force is determined exclusively by the adjustable pressing force that can be determined by pressure loading of the advancing piston. Accordingly, the cutting force control is especially independent of the respective stroke of the advancing piston rod and can be performed more precisely. When the pressing device is without pressure, the pressure spring, which is optionally compressed completely to a "block", is released and thus will return the circular blade, by loading of the advancing piston rod, into the ready position.

According to one embodiment of the invention, it is suggested that the pressing device is a slide engaging the pressure spring arranged between the advancing device and the circular blade. For actuation of the slide, a pneumatic air drive is provided. According to one embodiment of the invention, it is suggested that the slide embraces externally the blade head housing and is guided on the exterior side of the blade head housing. In this context, it is suggested that the slide engages with a projection, extending radially into the blade head housing, engages the pressure spring which is arranged in a recess of the blade head housing.

In a constructively different embodiment, the slide is embodied as a piston, arranged in the blade head housing and loaded by a pneumatic drive, whereby the pressure spring supported at the inner side of the blade head housing is connected to the piston and the piston pretensions the advancing piston rod into the ready position of the circular blade. This constructive solution has the advantage that the blade head housing is embodied of a unitary construction and that the pressing device with slide or piston is arranged in the interior of the blade head housing.

According to one embodiment of the invention, it is suggested that the advancing piston is embodied as a diaphragm which is seated on the advancing piston rod and is positioned with its circumference in the chamber so as to seal relative to the blade head housing. This has the advantage that based on the lack of loading of the advancing piston rod by the pressure spring, the diaphragm can be designed more simply because the operating pressures for adjusting the pressing or cutting force are reduced. The diaphragm, according to one embodiment of the invention, can also be a rolling diaphragm.

The cutting force control can be improved in an advantageous manner by providing a pressure sensor between the diaphragm and the circular blade for measuring the cutting force acting at the circular blade. According to different embodiments of the invention, this arrangement can be such that the pressure sensor is arranged between the diaphragm and either the axially positioned wall of the chamber at the pressure side or at a projection provided at the advancing piston rod. In both instances, the pressure sensor can measure at the diaphragm the force acting against the resistance of the circular blade resting on the lower blade.

According to a further embodiment of the invention, it is suggested that between the diaphragm and the blade support a damping member is arranged. The arrangement of such a damping member, loads caused by the circular blade at the pressure sensor and/or at the diaphragm, for example, in the form of impacts resulting from imbalanced circular blades, can be compensated and their effects onto the cutting force control can be minimized. According to alternative embodiments of the invention, the damping member can be positioned between the diaphragm and the projection of the advancing piston rod or between the pressure sensor and the projection. A further embodiment may be such that the advancing piston rod is divided transverse to its longitudinal axis and that the damping member is inserted between the thus formed rod portions. The damping element itself can be embodied as a shaped body of elastic material or can be embodied as a spring.

BRIEF DESCRIPTION OF THE DRAWINGS

In the drawing embodiments of the invention are represented which will be described in the following. It is shown in.

DESCRIPTION OF PREFERRED EMBODIMENTS

Figure 1:
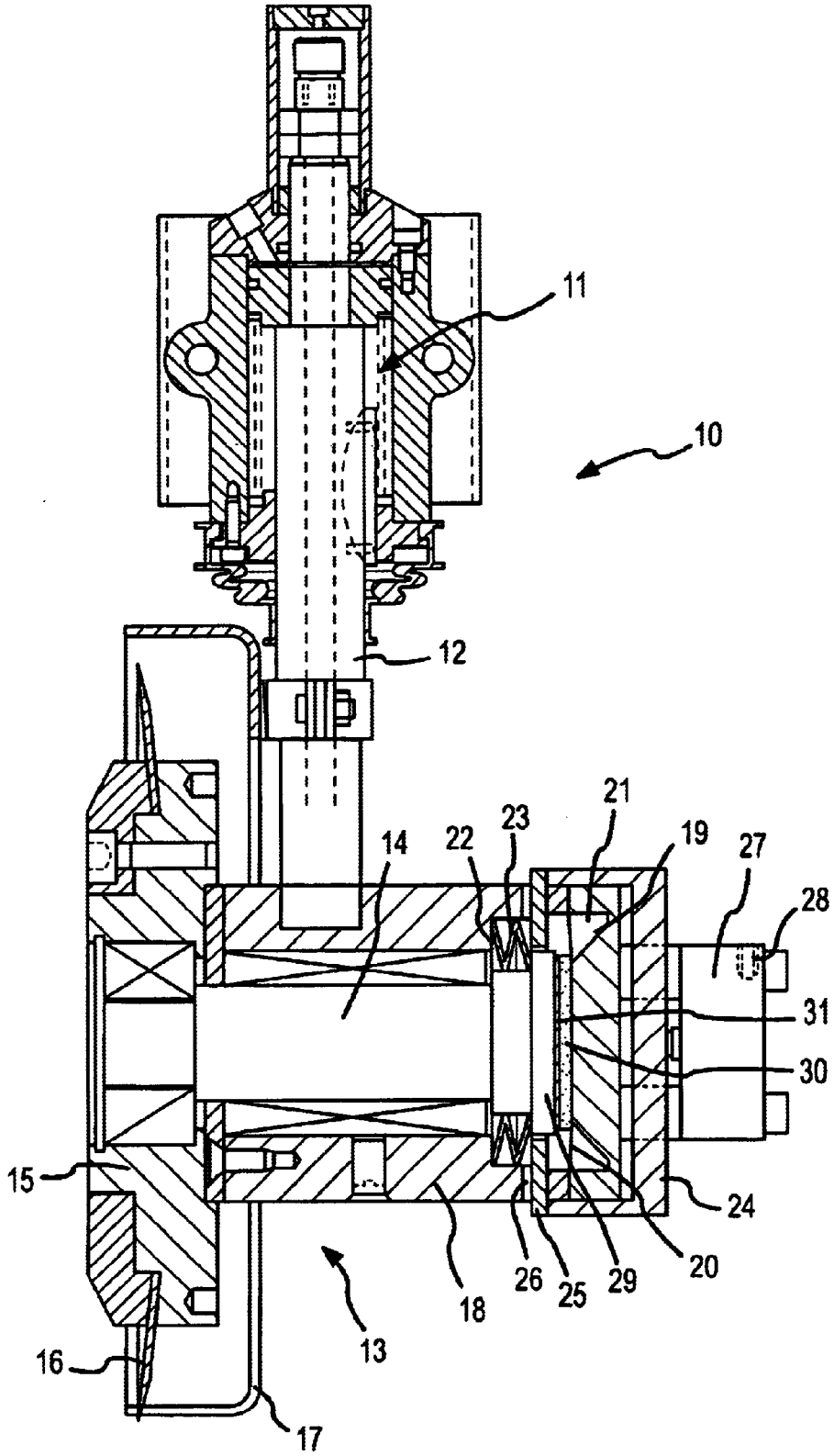
FIG. 1 a blade holder in longitudinal section.

In the represented blade holder 10 at the end of its lowering piston rod 12 of a lowering device 11, that is not part of the invention and is disclosed in the prior art according to DE 38 41 576 C2, a blade head 13 is provided in which an advancing piston rod 14 is moveably arranged transverse to the axis of the lowering piston rod 12. At the correlated end of the feed piston rod 14, a blade holding member 15 is arranged in which the circular blade 16 is secured. The circular blade 16 is surrounded by a hand protector 17 in the ready position shown in the drawing.

As not shown in further detail, the circular blade 16 can be moved to the left of the drawing by displacement of the advancing piston rod 14 into a non-represented cutting position in which it cooperates with a lower blade, which is also not shown.

For accomplishing this adjusting movement, a chamber 19 with a pneumatic connector 21 is arranged within the blade head housing 18. The advancing piston rod 14 penetrates the chamber 19, and a diaphragm 20 is arranged on the advancing piston rod 14 whereby the diaphragm acts as the advancing piston. The diaphragm 20 rests sealingly with its outer periphery against the corresponding inner wall of the chamber 19 within the blade head housing 18. The blade head housing 18 has a recess 22 adjacent to the chamber 19 in the direction of the blade holding member 15 in which cutout a spring 23 is arranged. The spring 23 is supported with one end at the blade head housing 18 and with the other end at the projection 29 of the advancing piston rod 14 so that the advancing piston rod 14 in the ready position shown in the drawing prestresses the circular blade 16.

The end of the pressure spring 23 resting at the projection 29 is engaged by a slide 24 with a projection 25, penetrating through an opening 26 into the blade head housing 18. The slide 24 is displaceable externally to the blade head housing 18. The slide 24 has the function of a pressing device for the pressure spring 23 because a pneumatic drive 27, configured as a piston drive with a piston 27*a*, with a pneumatic connector 28 is arranged at the end of the slide 24 which is facing away from the pressure spring 23. When loaded accordingly by compressed air, the piston 27*a* of slide 24 is moved in the direction of the cutting position of the circular blade 16 while at the same time the pressure spring 23 is compressed completely to a "block". The movement of the slide 24 is possible because of the projection 25 being positioned with respective play in the receiving opening 26 in the blade head housing 18.

When the circular blade 16 of the blade holder shown in the drawing is to be moved into the cutting position, first via the pneumatic connector 28 the pneumatic, drive 27 is activated which moves the slide 24 in the direction of the circular blade 16 so that the pressure spring 23 is completely compressed. Since the slide 24 is decoupled from the advancing piston rod 14 and upon compression of the pressure spring 23 is lifted from the projection 29 of the advancing piston rod 14, the advancing piston rod 14 will first remain in the represented position. By loading the diaphragm 20 via the correlated pneumatic connector 21, it is now possible with correspondingly reduced drive pressure to move in a finely adjusted manner the drive piston rod 14 in the direction of the cutting position of the circular blade until the circular blade 16 will come to rest at the correlated lower blade with the desired cutting force. When it is desired to return the circular blade 16 after completion of the cutting process into its ready position, the pneumatic drive 27 is first switched to be pressure-free and the block-compressed pressure spring 23 then forces, by engaging the projection 29, the lowering piston rod 14 into the position represented in the drawing.

The cutting force control is further improved in that a pressure sensor 30 is arranged which exactly measures the cutting force acting at the circular blade 16, respectively, at the lower blade.

Between the diaphragm 20 and the blade holding member 15 a damping member 31 is arranged between the pressure sensor 30 and the shaft projection 29. It is, for example, in the form of an additional spring in order to dampen impact on the membrane resulting from the circular blade 16 so that the precision of the cutting force control is not impaired.

Figure 2:
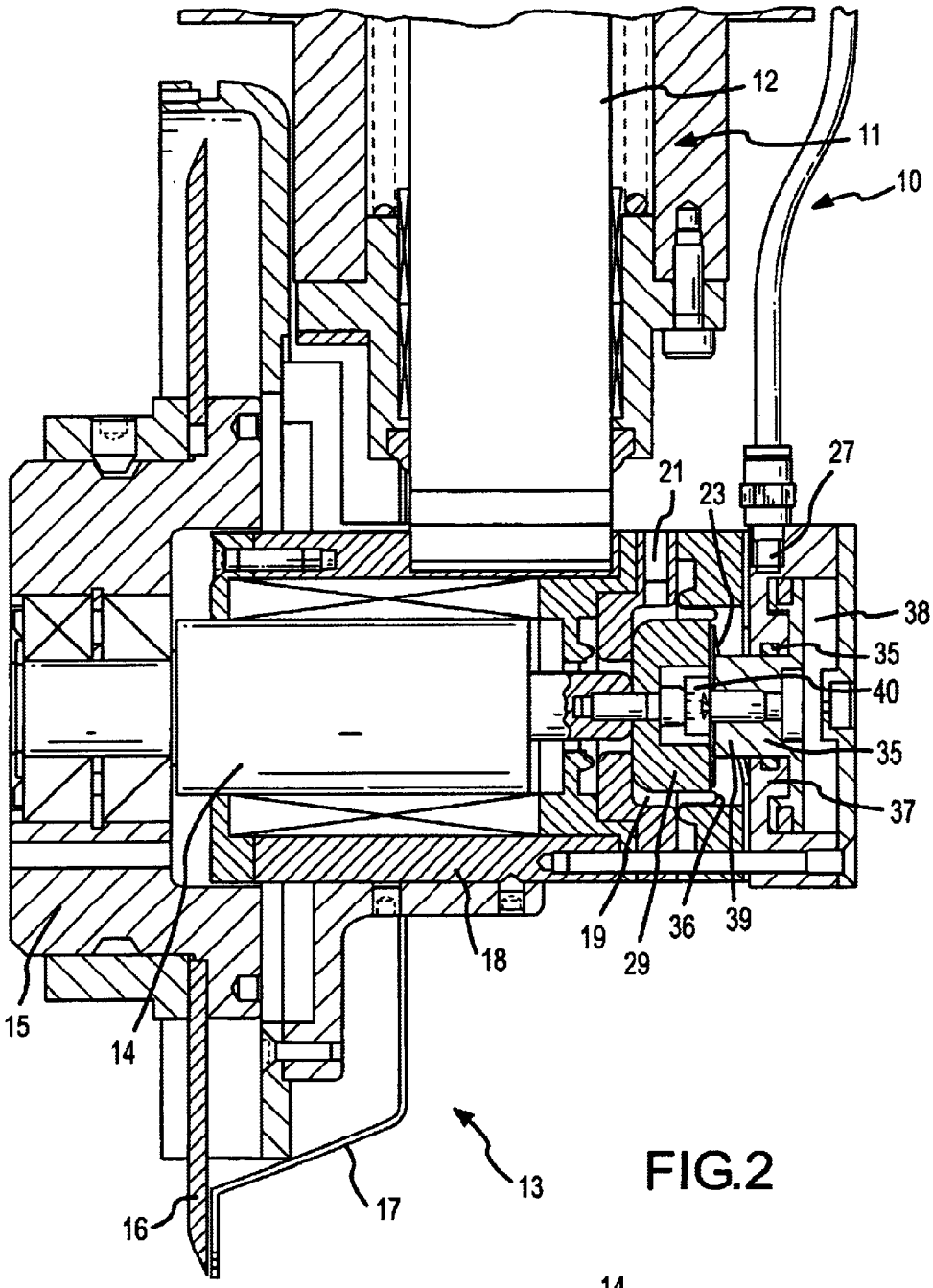
FIG. 2 the blade holder of FIG. 1 in another embodiment.
Figure 3:
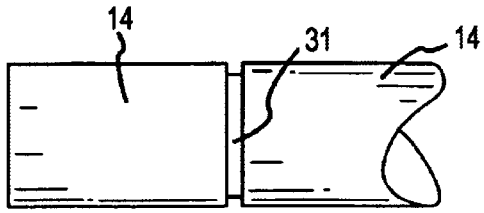
FIG. 3 the advancing piston rod with damping element of the embodiment shown in FIG. 1 in an individual representation.

In FIG. 2, a constructively changed embodiment of the inventive object shown in FIG. 1 is represented in which the slide which forms the pressing device is embodied as a slide piston 35 positioned in the interior of the blade head housing 18. In comparison to the blade holder represented in FIG. 1, it should be noted that in this embodiment according to FIG. 2 the cutting edge of the circular blade 16 is arranged at the inner side facing the housing 18 so that the circular blade 16 shown in the ready position in FIG. 2 must be moved to the right into it's cutting position.

In the interior of the blade head housing 18, the chamber 19 has coordinated therewith the pneumatic connector 21, which acts as the advancing piston, for advancing the circular blade 16, whereby the diaphragm is embodied as a rolling membrane 36 and is connected at the inner side of the blade head housing 18 and, on the other hand, to the shaft projection 29 so that a loading of the pneumatic connector 21 results in a movement of the advancing piston rod 14 to the right.

For embodying the pressing device, in the interior of the blade head housing 18 a partition 37 is provided which separates a chamber 38 in which a slide piston 35 can be moved to the right under the effect of the pneumatic drive 27. The slide piston 35 penetrates with its projection 39 the partition 37 and rests in the ready position of the circular blade 16 with its rear against the shaft projection 39. One end of the provided pressure spring 23 is supported at the partition 37 and the other end is connected by a screw 40 to the end face of the projection 39 of the slide piston 35. Accordingly, the pressure spring 23 forces the slide piston 35 respectively to the left so that the piston 35, by abutting the shaft projection 39, also tensions the advancing piston rod 14 into the ready position.

During cutting operation, the pneumatic connector 28 is actuated so that the slide piston 35, by means of the pressure flowing between the partition 37 and the piston 35, is moved to the right in the chamber 38 and the pressure spring 23 is compressed against the partition 37. Accordingly, the pressure spring 23 frees the path for an advancing movement of the advancing piston rod 14, without requiring overcoming the spring force, by loading the chamber 19 and, respectively, the rolling diaphragm 36.

The disclosed features of the object of these documents disclosed in the above description, the claims, the abstract, and the drawing, can be essential, individually as well as in any suitable combination with one another, for realizing the invention in its different embodiments.

What is claimed is:

1. In combination, a circular blade and a blade holder for cutting machines, comprising:

a blade head secured to a lowering device and comprising a blade head housing having a chamber;

said blade head further including a blade holding member;

a said circular blade being retained by said blade holding member;

an advancing device mounted in said blade head housing;

said advancing device comprising an advancing piston rod and an advancing piston actuating said advancing piston rod;

a biasing component acting on said advancing piston rod to press said advancing piston rod in a ready position of the circular blade;

said advancing piston rod acting on said blade holding member for moving the circular blade from a ready position into a cutting position, thereby overcoming the force of a said biasing component acting on said advancing piston rod to press said advancing piston rod In the ready position of the circular blade;

said advancing piston actuated by a first pneumatic drive and mounted end in said chamber;

said biasing component including a return spring and being mounted within said chamber, said biasing component having one end supported against said advancing device and another end supported against a support structure within said chamber at an axial spacing from said advancing piston with the axial spacing between said advancing piston and said support structure within said chamber being such that said biasing component is in a ready position compression when said one end of said biasing component is supported against said advancing device and said another end of said biasing component is supported against said support structure within said chamber; and a pressing device for increasing the compression of said biasing component beyond said ready position compression of said biasing component by loading said biasing component toward said support structure within said chamber while said axial spacing between said advancing piston and said support structure within said chamber remains constant, whereupon said one end of said biasing component previously supported against said advancing device is decoupled from and is no longer supported against said advancing device.

2. The combination according to claim 1, wherein said pressing device comprises a slide that is engageable with said biasing component and disposed proximate to said advancing device, and further comprises a second pneumatic drive for actuating the slide.

3. The combination according to claim 2, wherein said slide embraces externally the blade head housing.

4. The combination according to claim 2, wherein said slide has a projection radially extending into said blade head housing, wherein said projection engages said biasing component, and said biasing component is positioned in a recess of said blade head housing.

5. A blade holder according to claim 2, wherein said slide is a slide piston arranged in said blade head housing and loaded by a second pneumatic drive.

6. A blade holder according to claim 1, wherein said advancing piston is a diaphragm seated on said advancing piston rod, wherein said diaphragm resides in said chamber such that a circumference of said diaphragm seals against said blade head housing.

7. A blade holder according to claim 6, wherein said diaphragm is embodied as a rolling diaphragm.

8. A blade holder according to claim 6, and further comprising a pressure sensor positioned between said diaphragm and said circular blade and measuring a cutting force acting at the circular blade.

9. A blade holder according to claim 8, wherein said pressure sensor is arranged between said diaphragm and a side of said chamber proximal to said actuating piston rod.

10. A blade holder according to claim 8, further comprising a damping member positioned between said diaphragm and said blade holding member.

11. A blade holder according to claim 10, wherein said damping member is arranged between said diaphragm and a projection of said advancing piston rod.

12. A blade holder according to claim 10, wherein said damping member is a shaped body comprised of elastic material.

13. A blade holder according to claim 8, and further comprising a damping member arranged between said pressure sensor and a projection of said advancing piston rod.

14. In combination, a circular blade and a blade holder for cutting machines, comprising:

a blade head secured to a lowering device and comprising a blade head housing having a chamber;

said blade head further including a blade holding member;

said circular blade being retained by said blade holding member;

an advancing device including an advancing piston, said advancing device mounted in said blade head housing for moving the circular blade from a ready position into a cutting position;

a biasing component including a return spring and being mounted within said chamber, said biasing component having one end supported against said advancing device and another end supported against a support structure within said chamber at an axial spacing from said advancing piston with the axial spacing between said advancing piston and said support structure within said chamber being such that said biasing component is in a ready position compression when said one end of said biasing component is supported against said advancing device and said another end of said biasing component is supported against said support structure within said chamber; and a pressing device for increasing the compression of said biasing component beyond said ready position compression of said biasing component by loading said biasing component toward said support structure within said chamber while said axial spacing between said advancing piston and said support structure within said chamber remains constant, whereupon sold one end of said biasing component previously supported against said advancing device is decoupled from and is no longer supported against said advancing device.

* * * * *